United States Patent [19]

Thuries et al.

[11] 4,453,679

[45] Jun. 12, 1984

[54] APPARATUS FOR WINDING AND UNWINDING A FLEXIBLE ROD

[75] Inventors: Edmond Thuries, Meyzieu; Maurice Mähl, Decines; Jean-Paul Masson, Villeurbanne; Louis Malik, Caluire, all of France

[73] Assignee: Societe Anonyme dite: Alsthom-Atlantique, Paris, France

[21] Appl. No.: 362,323

[22] Filed: Mar. 26, 1982

[30] Foreign Application Priority Data

Mar. 31, 1981 [FR] France ..... 81 06440

[51] Int. Cl.[3] ..... B65H 75/00

[52] U.S. Cl. ..... 242/54 A

[58] Field of Search ..... 242/54 A, 54 R, 106; 343/877, 707

[56] References Cited

U.S. PATENT DOCUMENTS

| | | | |
|---|---|---|---|
| 2,327,163 | 8/1943 | Barrett | 250/33 |
| 2,772,548 | 12/1956 | Covington, Jr. et al. | 464/137 |
| 2,865,183 | 12/1958 | Fawick | 464/137 X |
| 2,904,272 | 9/1959 | Barrett | 242/54 A |
| 2,907,416 | 10/1959 | Comba et al. | 242/54 A |
| 3,387,634 | 6/1968 | Hilsenberg | 242/54 R X |

*Primary Examiner*—Stuart S. Levy
*Assistant Examiner*—Scott J. Haugland
*Attorney, Agent, or Firm*—Sughrue, Mion, Zinn, Macpeak & Seas

[57] ABSTRACT

Apparatus for winding and unwinding a flexible rod, said apparatus including a drum (20) on which the rod (9) is wound, said drum being disposed between two parallel plates (32, 33) and being mounted on a shaft (21) set in spherical bearings (24), said shaft (21) forming an angle of two to eight degrees with the perpendicular to the plane of the drum, the periphery of said drum having a groove which defines, with a band (43) surrounding the end surface of the drum, a volume (44) enclosing the rod, said volume having a rectangular cross-section whose small side is slightly larger than the diameter of the rod. The apparatus has application to driving the components of a telescopic disconnector switch.

4 Claims, 7 Drawing Figures

52
20
51

43
9

19
IV
V
62
61
51
52
III
III
V
50
106
107
33
9
45
IV 32
33
104
20
9
VI
43
44
50

APPARATUS FOR WINDING AND UNWINDING A FLEXIBLE ROD

BACKGROUND OF THE INVENTION

In French patent application No. 8, 104, 270 of Mar. 4, 1981, entitled "A telescopic disconnector switch" and filed on the same day as the priority application of the present invention, the French Applicant describes a disconnector switch with telescopic components in which the movements of the disconnector switch (turning on by extending the components, turning off by retracting the components) are caused by means of a resilient rod associated with means to make it rigid when under compression.

The rod is stored on a drum whose direction of rotation causes the rod to wind or unwind, as the case may be.

Two conditions must be satisfied to provide proper operation of the disconnector switch: firstly, the path of the rod where it leaves the drum must remain practically linear, buckling being reduced to a minimum; and secondly the rod must still be guided between the point where it leaves the drum and the point where it enters the means which make it rigid.

Preferred embodiments of the present invention provide a winding and unwinding apparatus which fulfills the above two conditions.

SUMMARY OF THE INVENTION

The present invention provides apparatus for winding and unwinding a flexible rod, said apparatus including a drum on which the rod is wound in contiguous turns, said drum having a groove at its periphery which groove defines, with a band surrounding the end surface of the drum, a volume enclosing the rod, said volume having a rectangular cross-section whose small side is slightly larger than the diameter of the rod, wherein said drum is disposed between two parallel plates and is mounted on a shaft set in spherical bearings, said shaft forming an angle of two to eight degrees with the perpendicular to the plane of the drum.

An idle pulley with a stationary axle is disposed in the neighbourhood of the drum where the rod leaves the drum.

Advantageously, the axle of the drum is constituted by a shaft on which the drum is mounted idle by means of spherical bearings which allow angular play of up to eight degrees, the drum being driven by a disk integral with the shaft which itself rotates, lugs in the drum engaging in cavities in the disk.

Preferably, the band is integral with the disk.

BRIEF DESCRIPTION OF THE DRAWINGS

A preferred embodiment of the invention is described with reference to the accompanying drawings in which.

MORE DETAILED DESCRIPTION

Figure 1A:
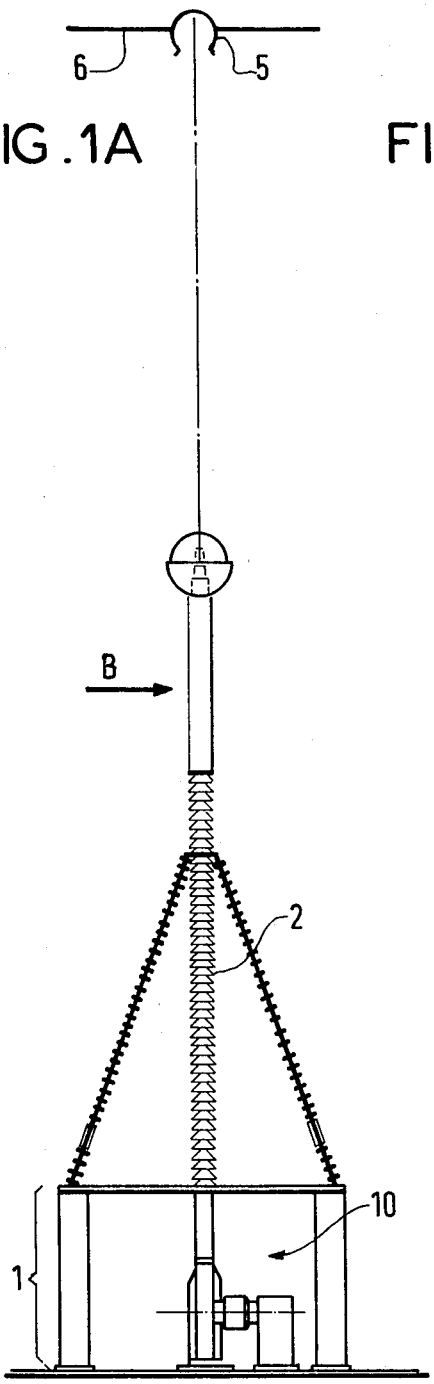
FIG. 1A is a front elevation of a telescopic disconnector switch using winding apparatus in accordance with the invention.
Figure 1B:
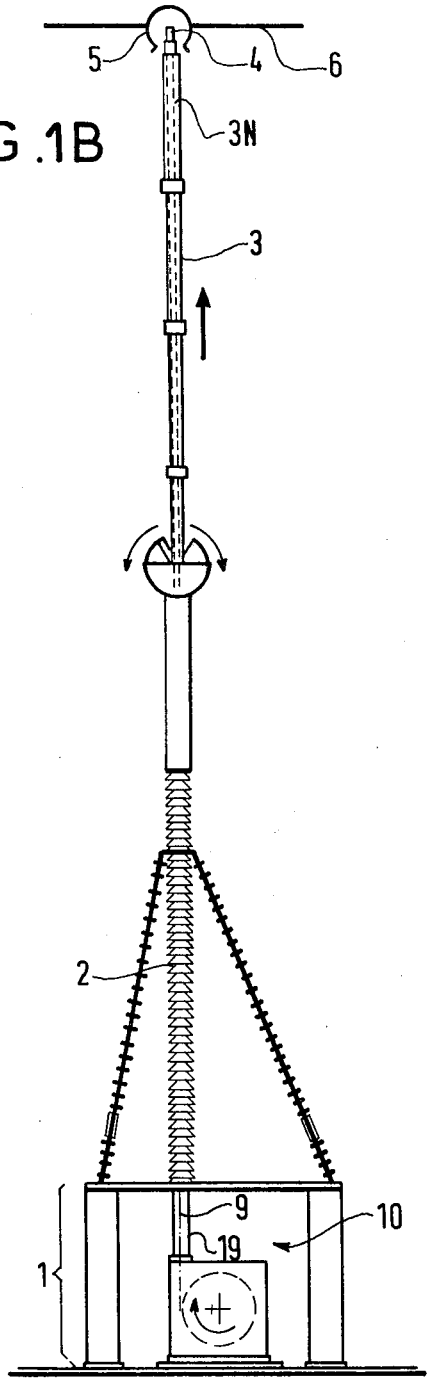
FIG. 1B is a side elevation of the same disconnector switch in the ON position.
Figures 2, 3:
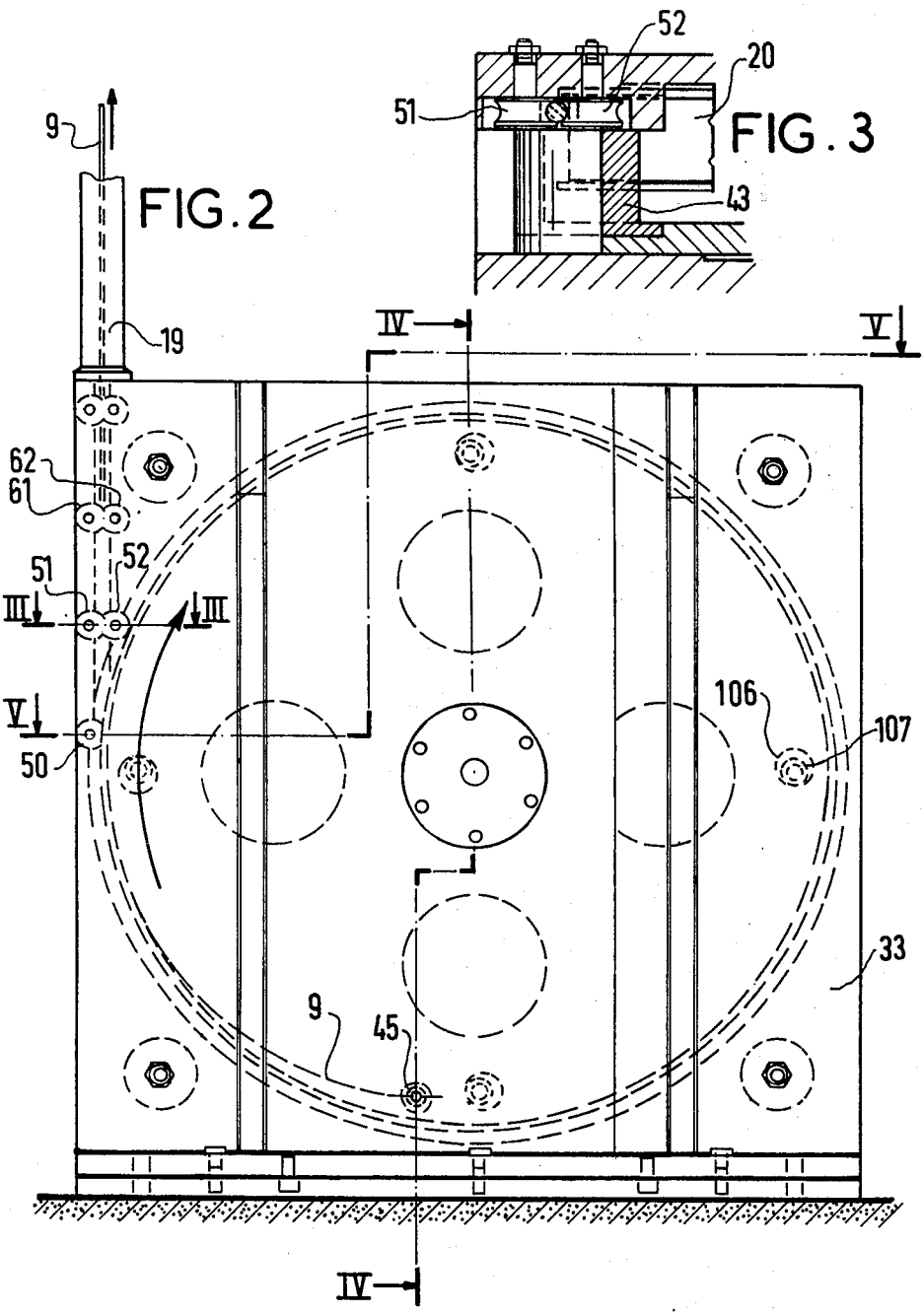
FIG. 2 is an elevation of winding apparatus in accordance with the invention.
FIG. 3 is a cross-section of the apparatus along line III—III of FIG. 2.

FIGS. 1A and 1B show a telescopic disconnector switch with a support frame 1 which supports an insulating column 2 bearing a plurality of retractable and extendable conductor components 3.

FIG. 1B shows the disconnector switch in the electrically ON position with its components extended; the last component 3N bears a contact 4 which co-operates with a contact 5 integral with an electric line 6.

The components are moved by means of a flexible rod 9 associated with a winding and unwinding apparatus 10 to which the present patent application relates.

The rod runs up a column 19 before entering the inside of a column 2.

The apparatus is illustrated in FIGS. 2 to 6.

Its main components are a cylindrical drum 20 through which a shaft 21 passes whose ends rest on bearings 22 and 23. The drum is mounted idle on said shaft by means of spherical bearings such as 24 which allow angular play of up to eight degrees. The bearings 22 and 23 are mounted between stationary parallel plates referenced 32 and 33.

The end surface of the drum has circular protrusions 41 and 42 which define a groove delimiting, together with a band 43 described more precisely hereinafter, an annular volume 44 in which the rod 9 is wound onto the drum.

The cross-section of said volume is rectangular with its smallest side slightly larger than the diameter of the rod.

The drum rotation shaft is horizontal and makes an angle of 2 to 8 degrees with the perpendicular which is common to the plates; in this way, the rod 9, fixed to a fixed point 45 of the drum and then forming a number of turns around the drum, leaves the drum at the same point regardless of the extent to which it is wound on the drum.

At the point where the rod 9 leaves the drum 20, a pulley 50 correctly guides the rod and prevents it from buckling when the drum is unwinding. The rod is then taken up between pairs of idle rollers such as 51, 52 and 61, 62 to keep it rigid under compression until it enters the column 19 where it is maintained by means described in the aforementioned French patent application.

The drum is driven by a motor, not illustrated, which may be equipped with an auxiliary manually-operated handle.

Figure 4:
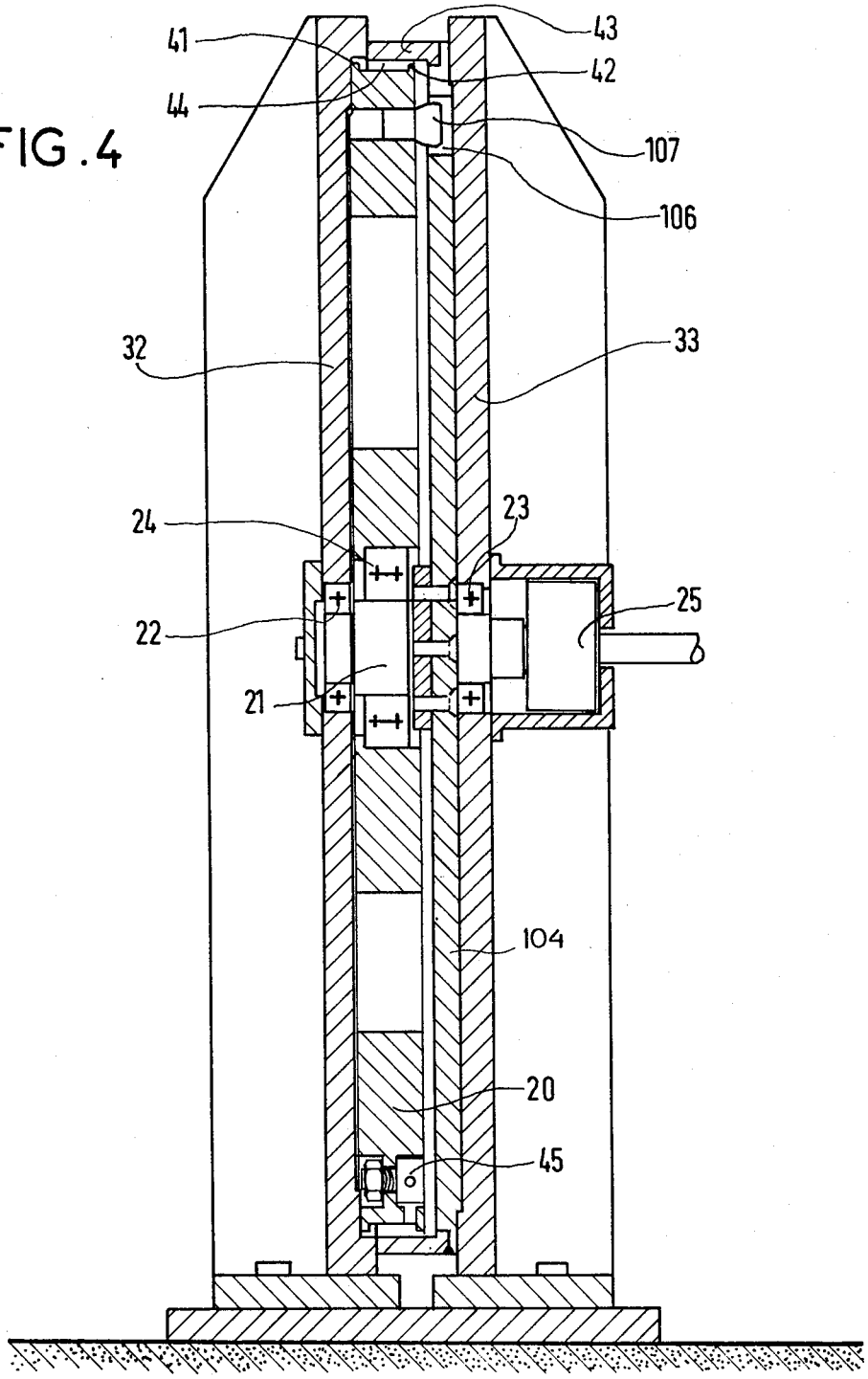
FIG. 4 is a cross-section along line IV—IV of FIG. 2.

In the example of FIG. 4, the motor drives the shaft 21 by means of a reduction gear 25; the drum is driven by an auxiliary disk 104 integral with the shaft 21 in which disk there is a series of cavities 106 (shown in FIG. 4) in which lugs 107 fast with the drum 20 engage. (In a variant, the cavities are in the drum 20 and the lugs on the disk). This indirect drive of the disk allows the drum some play relative to the shaft 21.

The band 43 is integral with the drive disk 104. Its width is smaller than the distance which separates the two plates so as to allow the drum to rotate; the band is very close to the drum so as to allow the rod no possibility of bending or of buckling when the drum is unwinding.

By way of example, the drum can have 4 or 5 turns of the rod wound onto it.

Figures 5, 6:
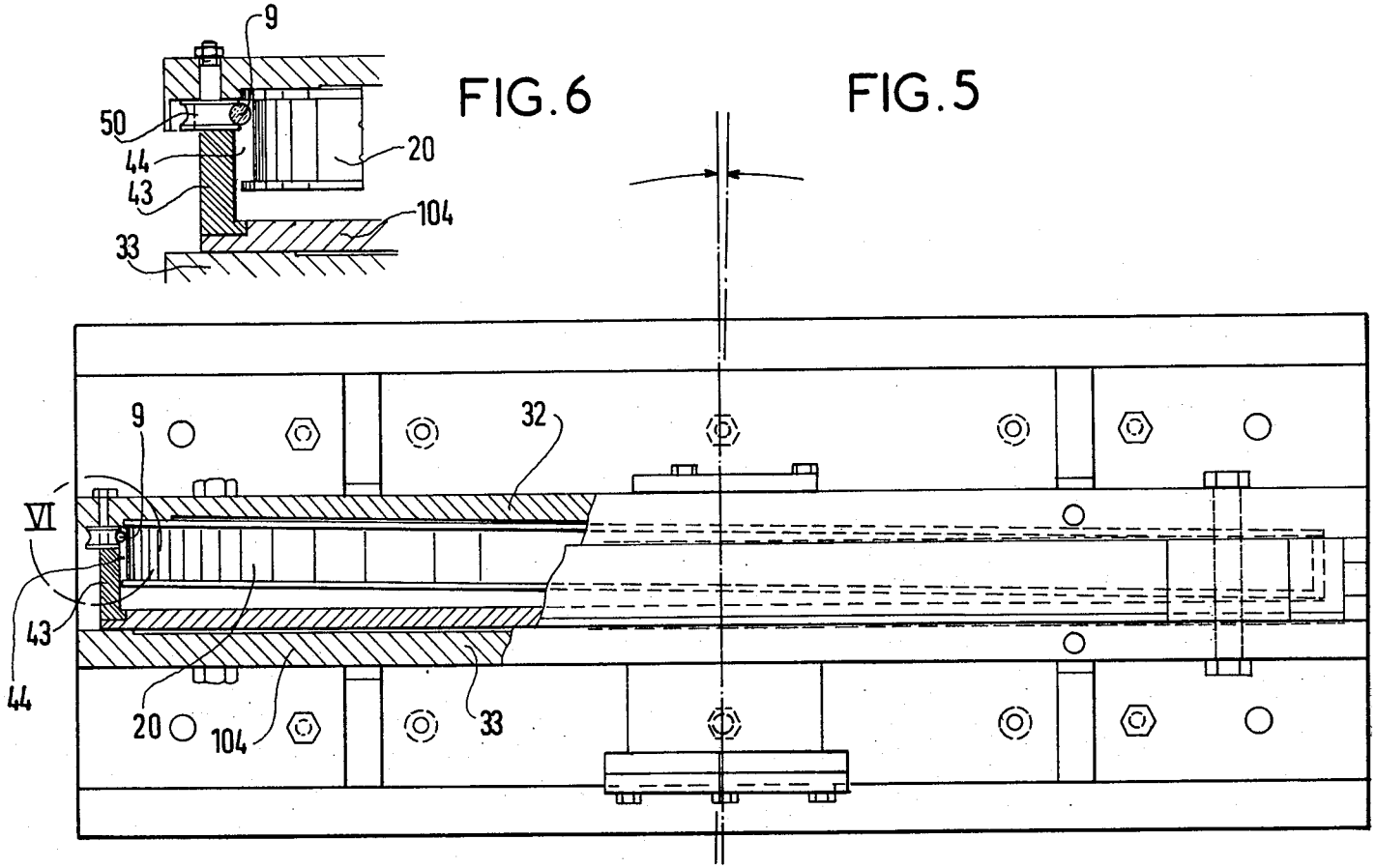
FIG. 5 is a cross-section of the apparatus along line V—V of FIG. 2.
FIG. 6 illustrates a detail VI of FIG. 5.

In the neighbourhood of the point where the rod leaves the drum, an extra guide means allows the space between the edge of the band and the adjacent plate to be filled in. Said guide means can thus guide the rod as illustrated in FIG. 5 after suitable machining of the plate 3 or, in a variant, by adding a ramp.

We claim:

1. Apparatus for winding and unwinding a flexible rod, said apparatus including a drum on which said rod is wound in contiguous turns, said drum having a groove at its periphery, a band surrounding an end surface of the drum, said groove and said band defining a volume enclosing the rod, said volume having a rectangular cross-section whose small side is slightly larger than the diameter of the rod, means for disposing said drum between two fixed parallel plates and for mounting said drum to a horizontal shaft set in spherical bearings allowing angular play of up to eight degrees between said drum and said shaft with said drum inclined relative to the shaft such that said shaft forms an angle of two to eight degrees with the perpendicular to the plane of the drum with the groove bearing said rod being inclined relative to the shaft axis to the same degree such that the rod forms a number of turns around the drum, leaves the drum at the same point regardless of the extent to which it is wound on the drum.

2. Apparatus according to claim 1, wherein a guide pulley is disposed adjacent one of said plates in the neighbourhood of the drum at the point where the rod leaves the drum.

3. Apparatus according to claim 1 or 2, wherein a disk is integral with the shaft which itself rotates, and said disk has cavities in which lugs on the drum engage such that said disk rotates said drum.

4. Apparatus according to claim 3, wherein the band is integral with the disk.

* * * * *